United States Patent [19]

Lesyk

[11] Patent Number: 5,014,617

[45] Date of Patent: May 14, 1991

[54] SELF-STORING AND INKING STAMP

[76] Inventor: Eugene Lesyk, 14161 Marine Dr., White Rock, British Columbia, Canada, V4B 1A9

[21] Appl. No.: 372,697

[22] Filed: Jun. 28, 1989

[51] Int. Cl.[5] ..... B41K 1/42

[52] U.S. Cl. ..... 101/333; 101/483

[58] Field of Search ..... 101/333, 327, 405, 103, 101/104, 398, 483

[56] References Cited

U.S. PATENT DOCUMENTS

| | | | |
|---|---|---|---|
| 681,554 | 4/1901 | Jamieson | 101/333 |
| 1,976,288 | 10/1934 | Ludewigs | 101/333 |
| 3,020,838 | 2/1962 | Prost | 101/333 |
| 3,333,536 | 8/1967 | Messersmith | 101/333 |
| 3,491,683 | 1/1970 | Farrow | 101/125 |
| 3,855,925 | 12/1974 | Funahashi | 101/333 |
| 3,948,173 | 4/1976 | Barasch | 101/398 |
| 4,267,772 | 5/1981 | Maitland | 101/103 |
| 4,579,057 | 4/1986 | Hewitt et al. | 101/368 |
| 4,676,162 | 6/1987 | Phipps, Sr. et al. | 101/405 |
| 4,735,143 | 4/1988 | Weir | 101/333 |

FOREIGN PATENT DOCUMENTS

| | | | |
|---|---|---|---|
| 162684 | 8/1985 | Japan | 101/405 |

*Primary Examiner*—Clifford D. Crowder
*Assistant Examiner*—Joseph R. Keating
*Attorney, Agent, or Firm*—Evenson, Wands, Edwards, Lenahan & McKeown

[57] ABSTRACT

A self-storing and inking stamp comprises an upper piece containing a stamping die at its lower end and a lower piece with an ink pad and piston which is accessible to the fingers of the user through a twisting bar. The piston and twisting bar are arranged in the lower piece such that they do not project beyond the plane of the base of the lower piece so that the lower piece can stably rest on a horizontal surface. The upper piece is threaded into the lower piece to bring the stamping die into contact with or at least into close proximity to the ink pad. Thereafter, the piston can be pushed axially in the direction of the ink pad and stamping die while being twisted to effect complete inking of the die.

13 Claims, 1 Drawing Sheet

SELF-STORING AND INKING STAMP

BACKGROUND OF THE INVENTION

The present invention relates to a self-storing and inking stamp apparatus and, more particularly, to the aforementioned type of apparatus which provides a relatively simple structure for both storing and inking a rubber stamp and an effective mechanism for making sure the stamping die has been adequately inked while cleaning the surface of the die to make sure there is a clean impression.

It has been well known for some time to provide rubber stamps with a self-storing inking capacity. For example, U.S. Pat. No. 3,020,838 shows a printing kit having an uppermost part which forms a stamping member, an intermediate part for receiving the stamping member and for holding an ink pad, and the lower receptacle for carrying printing accessories such as gummed labels. With the printing die of the stamping member in contact with the ink pad in the intermediate part when the stamping member is pushed down into its normal resting position, the stamping member is ready for immediate use when removed from the intermediate part. However, there is no positive means for assuring that the rubber stamp will always be in contact with the ink pad and ready to use.

U.S. Pat. No. 3,333,536 shows a stamp having an automatic inking mechanism in which an ink pad is held in contact with a die member during storage. The ink pad is positioned in the bottom of a circular cap which is pivotally attached to a housing having a suitable die fixed to a lower end thereof. The cap is pivoted to an open position when it is desired to form an image using the die member. However, this is a relatively complicated structure which requires a relatively large longitudinal dimension and is thus undesirable.

U.S. Pat. No. 3,491,683 discloses a printing appliance with a self-contained ink supply utilizing hydraulic pressure. It is necessary to place the appliance in press capable of exerting downward pressure on a plunger to compress the rubber so that the teeth on the frame penetrate a sachet allowing ink to escape into the reservoir and penetrate the felt and fabric sheets. Relaxation of the press allows the compressible frame to expand, creating a partial vacuum sufficient to hold the ink in suspension.

U.S. Pat. No. 3,855,925 shows a pocket hand stamp in which there is provided a holder for holding a printing plate on its bottom surface and a pair of box-shaped covers which pivot to the upper position of the holder to provide a handle for the stamp and also to serve to cover the printing plate when they are turned to a position under the bottom of the holder. An ink pad and the printing plate are impregnated with ink in advance s that continuous stamping is possible without using a separate stamp pad. However, this stamp does not utilize a self-inking feature which is both simple and effective.

U.S. Pat. No. 3,948,173 teaches the use of a relatively long marking assembly comprising a cylindrical member upon which marking indicia are supported. The assembly also includes a closure cap having an ink pad secured thereon and adapted to be placed over the cylindrical member by means of a screw coupling to prevent evaporation of the ink. When the cap is in place, the inner surface of the ink pad is in contact with the upper raised portion of the indicia members so that such members are always ready for immediate use when the cap is removed. Although the depth of the cap is such that it is intended with assembly the inner surface of the ink pad will contact the upper raised portions of the indicia member, there is no positive means to assure contact between the pad and the indicia members. This becomes more of a problem as the pad and members become worn from use, and the contact pressure between the two diminishes.

U.S. Pat. No. 4,267,772 describes a rubber stamp apparatus having an ink supply cartridge. The cartridge provides ink to the cavity which contains felt or other type of applicator and retains the ink such that when the ink supply cartridge is firmed engaged and held by a support member, an insignia is properly inked for each operation cycle. This apparatus is complicated and contains parts which can easily become disassociated and lost.

U.S. Pat. No. 4,579,057 teaches the use of an ink stamp having a rotatable cover which rotates from a first position covering a stamp element during storage to a second position over a curved top surface of a housing for the stamp element so that printing may be effected. However, the cover is made rotatable to prevent undesired ink transfer and to allow positioning of the stamper before making an imprint.

U.S. Pat. No. 4,676,162 describes a rubber stamp which includes a plunger which is slidably removable and spring biased upward in a housing sleeve. By pressing down on the plunger, a print block is forced into contact with paper and an evenly distributed transfer of ink is brought about. This device is not intended to self-store and ink the rubber stamp prior to use.

U.S. Pat. No. 4,735,143 shows an adjustable stamping device with a dust cover for protecting a stamp member and platen from dirt or damage when in storage and not in use.

While one or more of the foregoing prior art devices shows the use of self-storing rubber stamps, heretofore it has not been possible to devise a simple and effective manner of ensuring that the rubber stamp is always inked before use and, at the same time, assuring the user that the stamp die will have debris and build-up wiped away so as to make a neat, clean impression.

SUMMARY OF THE INVENTION

It is an object of the present invention to provide a self-storing and inking stamp apparatus such as a rubber stamp which overcomes the problems and disadvantages of the prior art and which provides a simple yet effective means for assuring that inking has occurred prior to use to avoid a loss of time and an inadequate impression on the article to be stamped.

Another object of my invention is to provide a compact stamp which has relatively few parts and which can be stably supported on a surface when the stamp apparatus is not in use.

The foregoing has been achieved in accordance with the present invention by providing a cylinder made of plastic or the like comprising a top portion having a stamp die affixed to the bottom thereof and a separable bottom portion containing an ink pad and piston. The top and bottom portions are joined together by male and female threaded portions or a similar securing arrangement so that the top unit can screw into the bottom unit for storage of the stamp and also for inking. The bottom unit contains a piston with an ink pad between the piston and the stamp on the upper unit. A twisting bar is provided on the exterior side of the piston so as to twist the piston and ensure that the rubber stamp is inked before use and any debris or build-up is removed from the stamping die.

In accordance with my invention, the piston can be either pushed up or turned up so as to provide a ready ink pad for repetitive stamping. The piston can be formed integrally with the ink pad or separately therefrom. According to another embodiment, the piston could have a cavity into which the ink pad is placed.

In use, the piston is both advanced and twisted as it approaches the stamp which has been threaded into the base to assure complete coverage of the alpha numeric information or design which is contained on the face of the stamp.

According to another embodiment of the present invention, the upper portion of the top unit could have a smaller diameter than the lower portion near the threaded area so as to provide a better grip for the user.

BRIEF DESCRIPTION OF THE DRAWINGS

These and further features, objects and advantages of the present invention will become more apparent from the following detailed description when taken in conjunction with the accompanying drawing which shows several presently preferred embodiments in accordance with my invention and wherein.

DETAILED DESCRIPTION OF PRESENTLY PREFERRED EMBODIMENTS

Figure 1:
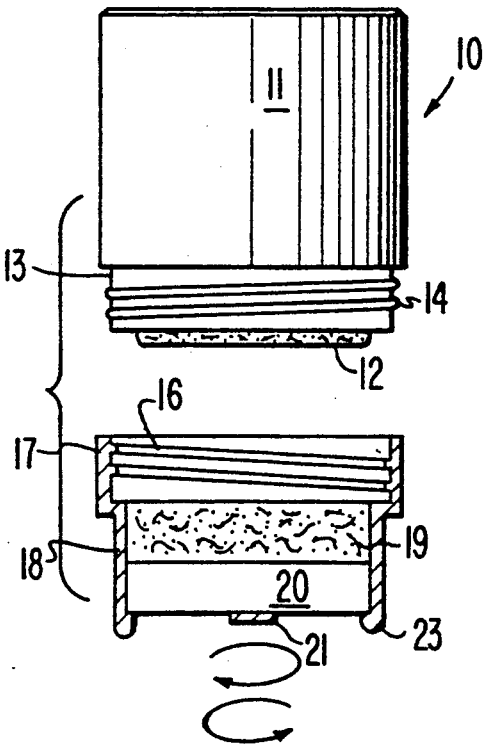
FIG. 1 is an exploded schematic view of the stamping apparatus in accordance with my present invention showing the top unit separated from the bottom unit which is shown in section.

Referring now to the drawings and, in particular, to FIG. 1 there is shown and designated generally by the numeral 10 an upper unit 11 containing the stamp die 12 made of rubber, felt or other suitable material with a reduced portion 13 at the bottom of the unit 11 containing a threaded male portion 14. The upper unit can be cylindrical in cross-section or having any other suitable shape which facilitates gripping by the user. A bottom base portion 15 comprises an upper portion having a female threaded portion 16 on the inner annular surface of an upper portion 17 of the base 15. A reduced lower portion 18 of the base 15 contains an ink pad 19 which is exposed to the rubber stamp die 12 when the top unit 11 is screwed into the base 15 by means of threads 14, 16.

A piston 20 is also arranged compactly in the base 15 and contacts the ink pad 19 on a surface opposite the surface exposed to the stamp die 12. The piston 20 is provided with a twisting bar 21 which is designed to twist the piston and associated ink pad 19 relative to the hose 15 in the clockwise and counterclockwise directions as shown by the arrows in FIGS. 1 and 4 so as to wipe the surface of the stamping die 12 clean of debris and ink build-up. During the twisting of the twisting bar 21 and the pad 19, the piston can also simultaneously be used to push the ink pad 19 relative to the base 15 toward and away from the stamp 12 to make sure that a sufficient amount of ink is placed on the stamp 12.

Figure 2:
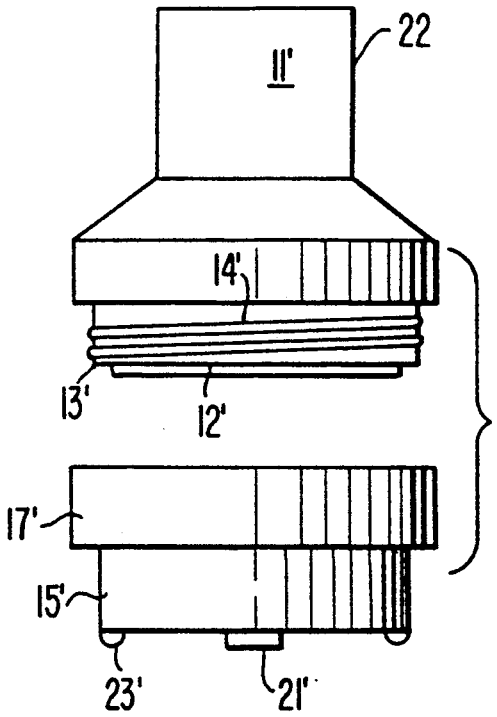
FIG. 2 is an exploded elevational view of another embodiment in accordance with my invention wherein the top unit has a reduced diameter upper portion for easier gripping.

In another embodiment as shown in FIG. 2, similar parts are designated by the same numerals as in FIG. 1 but are primed. In FIG. 2 the upper unit 11' is provided with a reduced cylindrical portion 22 for easier gripping by the hand of the user. In all other respects, the embodiment of FIG. 2 is identical to that of FIG. 1. Furthermore, the reduced portion can have any desired cross-section, e.g. an oblong cylinder. It will be noted that in FIGS. 1 and 2, the base 15, 15' has a portion 23, 23', respectively, which protrudes from the bottom so that the twisting bar 21, 21' is always located within the base so that the unit can rest stably on a flat surface and the twisting bar will not be accidently moved. This arrangement also provides for more compactness in the overall stamp profile.

Figure 3:
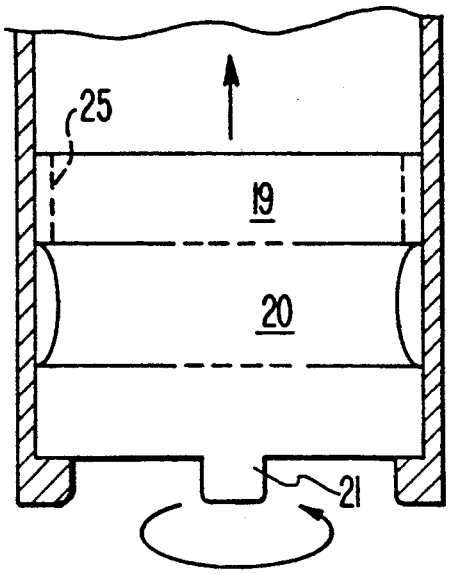
FIG. 3 is a schematic elevational view of the base portion in cross-section to illustrate the construction and operation of the ink pad and twisting bar.
Figure 4:
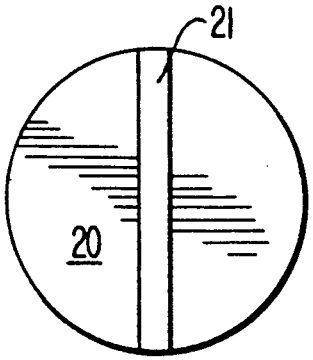
FIG. 4 is a bottom view of the twist bar and piston shown in FIG. 3.

A more detailed showing of the ink pad and piston is shown in FIGS. 3 and 4 wherein the piston 20 has a tight friction fit within the base 15. In this embodiment, the piston is formed as one piece with a plastic twist bar 21 on the bottom. A cavity is provided at one end of the piston 20 in proximity to the top portion of the base so as to receive the ink pad 19 which can be loaded with ink from a source of supply. The wall of the cavity is designated by the numeral 25.

While I have shown and described several embodiments in accordance with my invention, it is to be understood that the same is susceptible of numerous changes and modifications as will be apparent to one of ordinary skill in the art. Therefore, I do not intend to be limited to the details shown and described herein but intend to cover all such changes and modifications as are encompassed by the scope of the appended claims.

I claim:

1. A self-storing and inking stamp apparatus comprising a first unit containing a stamping die, a second unit containing and ink pad and arranged to be operatively engaged with the first unit such that the stamping die and ink pad are brought at least with proximity with each other, and means operatively associated with the second unit for pushing the ink pad toward the stamping die relative to the second unit and including a twisting bar for twisting the ink pad relative to the second unit to effect full inking of the stamping die.

2. The apparatus according to claim 1, wherein the first unit has a threaded portion, and the second unit has a threaded portion arranged to cooperate with the threaded portion on the first unit.

3. The apparatus according to claim 1, wherein the means comprises a piston arranged such that the ink pad is disposed between the stamping die and the piston.

4. The apparatus according to claim 3, wherein the first unit has a threaded portion, and the second unit has a threaded portion arranged to cooperate with the threaded portion on the first unit.

5. The apparatus according to claim 1, wherein the twisting bar is arranged on the piston.

6. The apparatus according to claim 5, wherein the first unit has a threaded portion, and the second unit has a threaded portion arranged to cooperate with the threaded portion on the first unit.

7. The apparatus according to claim 6, wherein the piston and twisting bar are located within an outside profile of the second unit.

8. The apparatus according to claim 1, wherein the first unit has a reduced portion to facilitate gripping.

9. The apparatus according to claim 8, wherein the first unit has a threaded portion, and the second unit has a threaded portion arranged to cooperate with the threaded portion on the first unit.

10. The apparatus according to claim 9, wherein the means comprises a piston arranged such that the ink pad is disposed between the stamping die and the piston.

11. The apparatus according to claim 10, wherein the twisting bar is arranged on the piston.

12. The apparatus according to claim 11, wherein the piston and twisting bar are located within an outside profile of the second unit.

13. A method for inking a stamping die, comprising the steps of:

moving a first unit containing a stamping die into engagement with a second unit containing an inked pad until the stamping die and inked pad are at least in proximity to each other, pushing the inked pad relative to the second unit into contact with the stamping die while twisting the inked pad relative to the second unit, and separating the first and second units to use the stamping die for a printing operation.

* * * * *